US007319835B2

(12) United States Patent
Ahn

(10) Patent No.: US 7,319,835 B2
(45) Date of Patent: Jan. 15, 2008

(54) IMAGE FORMING DEVICE HAVING FIRST AND SECOND LIGHT PROVIDING UNITS

(75) Inventor: Dong-cheol Ahn, Youngin (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/419,800

(22) Filed: Apr. 22, 2003

(65) Prior Publication Data

US 2004/0005170 A1 Jan. 8, 2004

(30) Foreign Application Priority Data

Jul. 2, 2002 (KR) ..... 2002-38053

(51) Int. Cl.
*G03G 21/00* (2006.01)
*G03G 15/16* (2006.01)

(52) U.S. Cl. ..... 399/129; 399/296

(58) Field of Classification Search ..... 399/128, 399/129, 296, 219, 98; 355/1
See application file for complete search history.

(56) References Cited

U.S. PATENT DOCUMENTS 4,534,641 A * 8/1985 Gilliland et al. ..... 399/187
5,530,525 A * 6/1996 Tsujita et al. ..... 399/343
6,198,892 B1 * 3/2001 Ohara ..... 399/128
6,205,306 B1 * 3/2001 Ishida ..... 399/128
6,208,820 B1 * 3/2001 Nami ..... 399/128
6,324,373 B1 * 11/2001 Park ..... 399/296
6,356,726 B1 * 3/2002 Campbell et al. ..... 399/128

FOREIGN PATENT DOCUMENTS

JP 59228683 A * 12/1984
JP 60247259 A * 12/1985
JP 04238371 A * 8/1992
JP 04270363 A * 9/1992

OTHER PUBLICATIONS

English Abstract for Japanese Patent No. 59228683, Publication Date: Dec. 22, 1984 (Cited in May 6, 2004 Office Action).

* cited by examiner

*Primary Examiner*—Robert Beatty
(74) *Attorney, Agent, or Firm*—Staas & Halsey LLP

(57) ABSTRACT

An image forming device, including a charging unit to electrically charge a surface of an organic photoconductive medium; a light exposure unit to form an electrostatic latent image on the surface of the organic photoconductive medium; a developing unit to develop the electrostatic latent image formed with a developer; a transfer roller to transfer an image developed by the developing unit to a recording paper; a light array having a plurality of light sources arranged in a predetermined pattern; a first light path providing unit to form a light path to receive a first light portion emitted from the light sources and to allow the light to be projected on the organic photoconductive medium between the developing unit and the transfer roller; and a second light path providing unit to form a light path to receive a second portion of the light emitted from the light sources and to allow the light to be projected onto the organic photoconductive medium passing through the transfer roller, thereby removing an electrostatic latent image remaining on the surface of the organic photoconductive medium.

4 Claims, 4 Drawing Sheets

IMAGE FORMING DEVICE HAVING FIRST AND SECOND LIGHT PROVIDING UNITS

CROSS-REFERENCE TO RELATED APPLICATIONS

This application claims the benefit of Korean Application No. 2002-38053, filed Jul. 2, 2002, in the Korean Intellectual Property Office, the disclosure of which is incorporated herein by reference.

BACKGROUND OF THE INVENTION

1. Field of the Invention

The present invention relates to an image forming device, and more particularly, to an image forming device which projects light emitted from a light source onto a predetermined area of a photosensitive medium, thereby improving an image transfer efficiency and removing a remaining electrostatic latent image.

2. Description of the Related Art

Image forming devices such as photocopiers, printers, facsimile machines, and multi-function machines are used to print images. Among these devices, printers are most frequently used to reproduce computer-processed information.

FIG. 1 is a schematic view showing a conventional image forming device.

Referring to FIG. 1, an image forming device includes a charging unit 10, an organic photoconductive drum 20, a light exposure unit 30, a developing unit 40, a transfer roller 50, a pre-transfer lamp 60, and a latent image removing lamp 70.

A charging roller 10*a* is electrically charged by a voltage and is rotated to electrically charge a photosensitive medium coated along an external circumference of the organic photoconductive drum 20. Then, an electrostatic latent image is formed on the organic photoconductive drum 20 exposed to light emitted from the light exposure unit 30. Next, the developing unit 40 develops the electrostatic latent image formed on the organic photoconductive drum 20 by using a developer.

The transfer roller 50 transfers an image formed by the developing unit 40 to a recording paper (not shown). The image forming device fuses the image printed on the recording paper by using a fusing unit (not shown) and discharges the paper.

Meanwhile, the pre-transfer lamp 60 is positioned at a position to project the light onto an area of the organic photoconductive drum 20 that corresponds to the area between the developing unit 40 and the transfer roller 50. The pre-transfer lamp 60 projects the light to the developer coated on the surface of the organic photoconductive drum 20 to thereby increase an electric potential of the developer. Accordingly, a binding force of the developer decreases and thus image transfer efficiency is improved. At this time, the light emitted from the pre-transfer lamp 60 is focused on the organic photoconductive drum 20 by a lens 62 which corresponds to the pre-transfer lamp 60.

The pre-transfer lamp 60 may be disposed to project the light onto a backside of the recording paper (not shown). At this point, since the transmissivity of the light varies depending on features of the recording paper, there may be a variation in the transfer efficiency. In consideration of this fact, the pre-transfer lamp 60 may be disposed at a position A to project the light directly onto the surface of the organic photoconductive drum 20 in the same direction as the dotted line of FIG. 1.

Meanwhile, in order to form a new electrostatic latent image on the organic photoconductive drum 20, it is necessary to remove the remaining latent image (a remaining electric potential) that still remains after passing through the transfer roller 50. The latent image removing lamp 70 projects light onto the area of the organic photoconductive drum 20 that has already passed the transfer roller 50 to remove the remaining latent image.

As described above, such a conventional image forming device must separate the pre-transfer lamp 60 and the latent image removing lamp 70 to maintain transfer efficiency and remove the remaining latent image to improve the image quality.

FIG. 2 is a view showing the arrangements of the pre-transfer lamp 60 and the latent image removing lamp 70.

Referring to FIG. 2, the pre-transfer lamp 60 and the latent image removing lamp 70 are structured so that a plurality of LED emitting elements are arranged on a separate PCB base plate in a predetermined pattern, and provided with a power via a separate power cable 90.

That is, the conventional image forming device must include separate light emitting elements to project the light to the organic photoconductive drum 20, thereby improving the transfer efficiency and the image quality. The light emitting elements require a separate base-plate to be arranged thereon and the separate power cable 90 to supply the power therethrough. Accordingly, there are problems due to complicated structure and increased cost.

SUMMARY OF THE INVENTION

Accordingly, it is an aspect of the present invention to solve the above problems in the conventional apparatus.

It is another aspect of the present invention to provide an image forming device capable of dividing the light emitted from a light source, a first part being projected to an area of an organic photoconductive drum corresponding to the area between a developing unit and a transfer roller in order to improve an image transfer efficiency, a second part being projected to remove a latent image remaining on the organic photoconductive drum after being developed.

Additional aspects and advantages of the invention will be set forth in part in the description which follows and, in part, will be obvious from the description, or may be learned by practice of the invention.

The foregoing and/or other aspects are achieved by providing an image forming device including an organic photoconductive medium; a charging unit to electrically charge a surface of the organic photoconductive medium; a light exposure unit to form an electrostatic latent image on the surface of the organic photoconductive medium; a developing unit to develop the formed electrostatic latent image with a developer; a transfer roller to transfer the image developed to a recording paper; a light array including a plurality of light sources arranged in a predetermined pattern to emit light; a first light path providing unit to provide a first light path to receive a first portion of the light emitted from the light sources and to allow the received light to be projected on the photoconductive medium between the developing unit and the transfer roller; and a second light path providing unit to form a second light path to receive a second portion of the light emitted from the light sources and to allow the received light to be projected onto the photoconductive medium passing through the transfer roller, thereby removing the electrostatic latent image from the surface of the organic photoconductive medium.

The first and second light providing units may be optical fibers to advance the incident light by an inner total reflection.

BRIEF DESCRIPTION OF THE DRAWINGS

These and/or other aspects and advantages of the invention will become apparent and more readily appreciated from the following description of the preferred embodiment, taken in conjunction with the accompanying drawings of which.

DETAILED DESCRIPTION OF THE PREFERRED EMBODIMENTS

Figure 1:
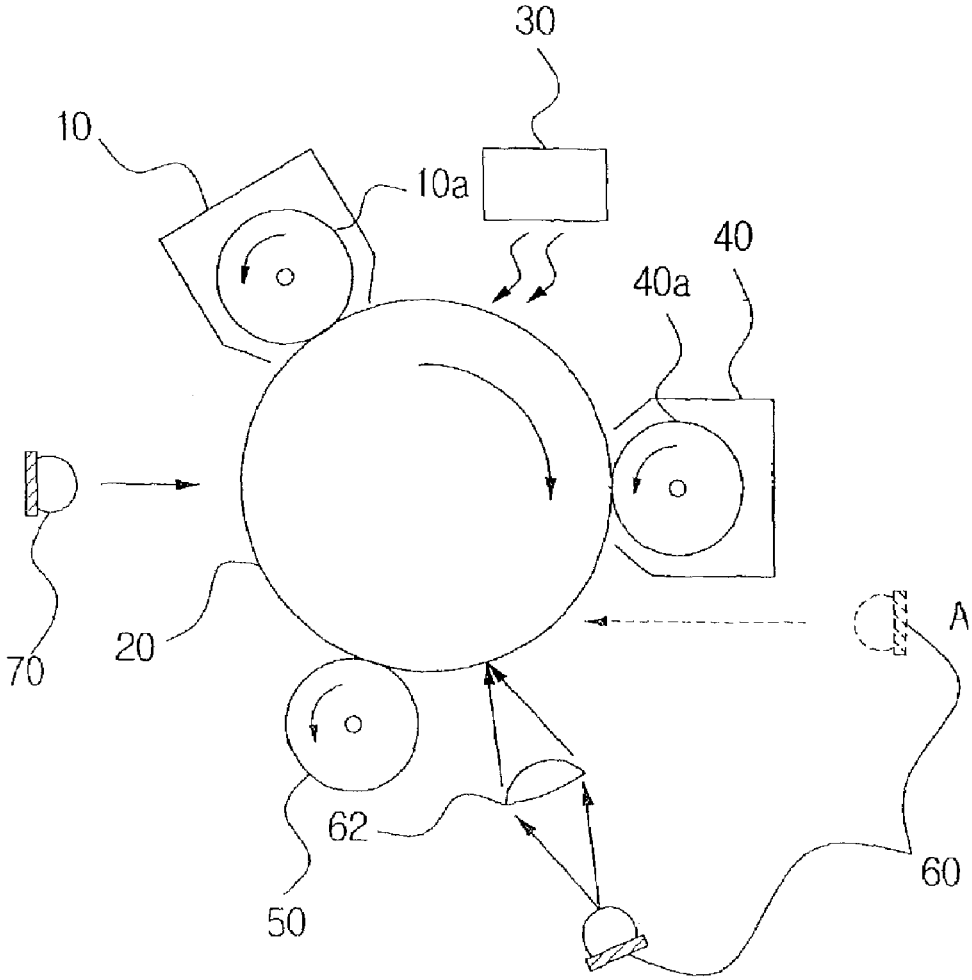
FIG. 1 (PRIOR ART)
FIG. 1 is a schematic cross-sectional view showing a conventional image forming device.

Reference will now be made in detail to the present preferred embodiment of the present invention, examples of which are illustrated in the accompanying drawings, wherein like reference numerals refer to like elements throughout.

Figure 3:
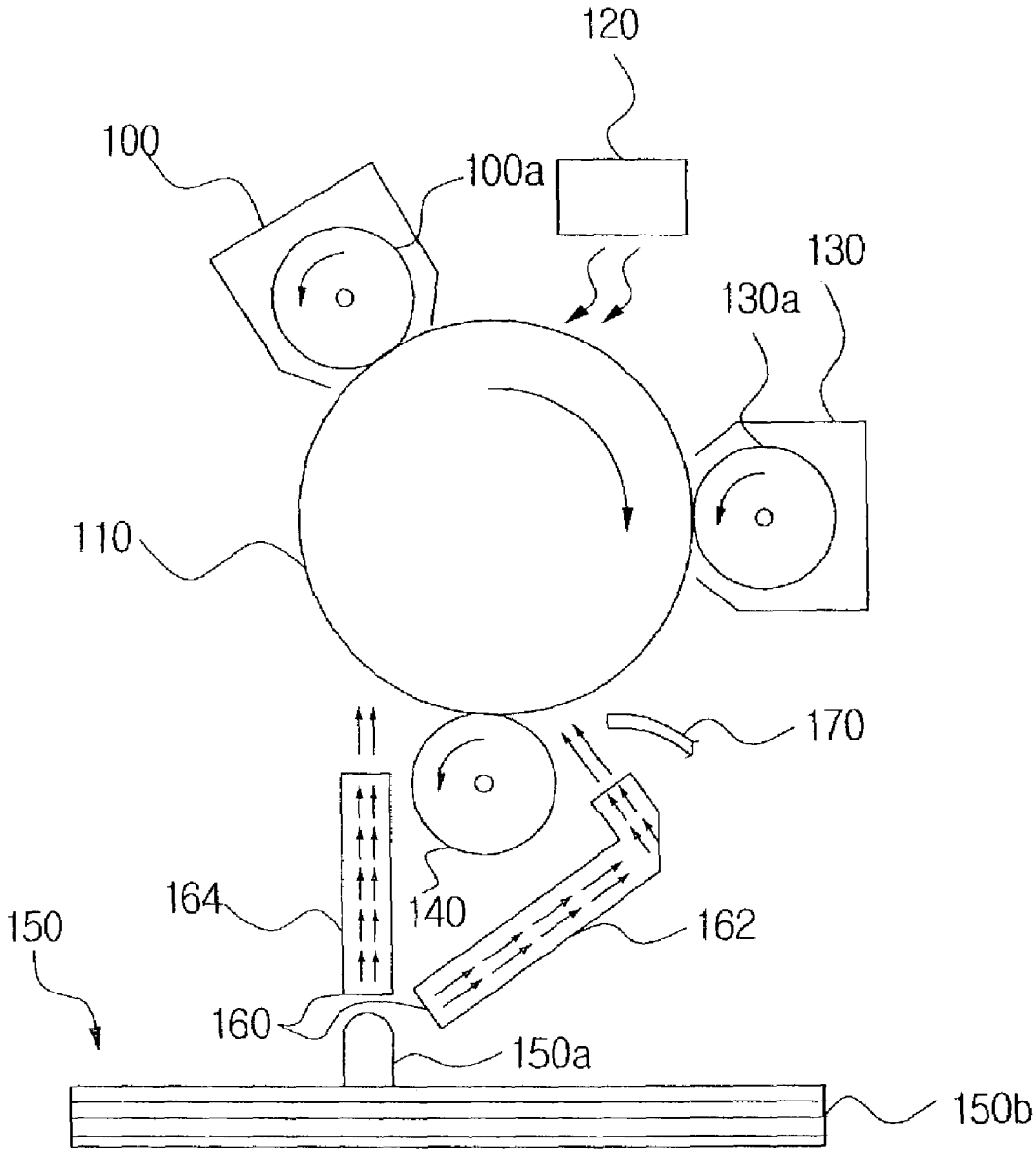
FIG. 3 is a schematic cross-sectional view showing an image forming device according an embodiment of the present invention.

FIG. 3 is a cross-section view showing an image forming device having a light path providing unit according to an embodiment of the present invention.

Referring to FIG. 3, the image forming device includes a charging unit 100, an organic photoconductive drum 110, a light exposure unit 120, a developing unit 130, a transfer roller 140, a light array 150, and a light path providing unit 160.

The charging unit 100 electrically charges a surface of the photosensitive drum 110 employed as a photosensitive medium to form a uniform electric charge layer. That is, a charging roller 100*a* disposed in the charging unit 100 electrically charges an external circumference of the organic photoconductive drum 110 uniformly by being rotated.

The light exposure unit 120 projects the light onto the surface of the organic photoconductive drum 110 electrically charged by the charging unit 100 and forms an electrostatic latent image.

The developing unit 130 develops the electrostatic latent image formed on the organic photoconductive drum 110 by the light exposure unit 120 with a developer having an electric charge.

The transfer roller 140 rotates in contact with the organic photoconductive drum 110 and transfers the developed image of the organic photoconductive drum 110 to the incoming recording paper (not shown).

Figure 2:
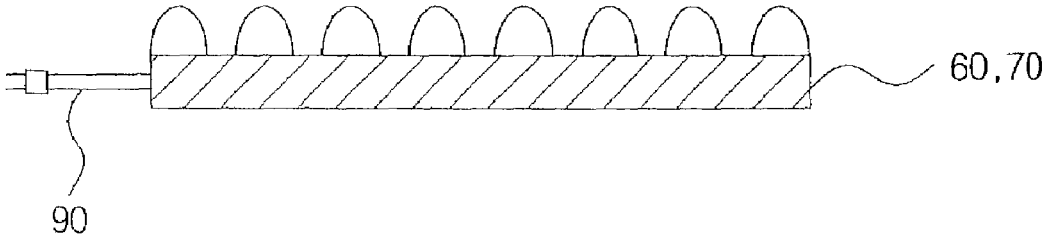
FIG.2 (PRIOR ART)
FIG. 2 is a view showing arrangements of the pre-transfer lamp and the latent image removing lamp of FIG. 1.

The light array 150 is structured in a manner that a plurality of light sources 150*a* are arranged on a base-plate 150*b* in a predetermined pattern in the same manner as that of FIG. 2. The light sources 150*a* may be light emitting elements such as LEDs, and are supplied with a power from a power supplying portion (not shown) under the control of a controller (not shown) when a printing operation begins to be performed.

The light path providing unit 160 provides light paths to receive the light emitted from the light sources 150*a* and to project the light onto the organic photoconductive drum 110 therethrough. One of the light paths allows the light to be projected to an area of the organic photoconductive drum 110 that passes through a developing process and is placed ahead of a transfer process. Another light path allows the light to be projected onto an area of the organic photoconductive drum 110 passing through the transfer process.

The light path providing unit 160 has a first light path providing unit 162 and a second light path providing unit 164.

The first light path providing unit 162 provides a light path to receive a part of the light emitted from the light sources 150*a* and to project the light onto an area of the photosensitive drum 110 that is placed between the developing unit 130 and the transfer roller 140.

In order to reduce an electric potential difference between an area exposed to the light by the light exposure unit 120 and a non-exposed area prior to the transfer process, the first light path providing unit 162 provides the light path to allow the light to be projected to the organic photoconductive drum 110 between the developing unit 130 and the transfer roller 140.

The first light path providing unit 162 allows the light to be projected onto the developer coated on the surface of the organic photoconductive drum 110 that is placed between the developing unit 130 and the transfer roller 140, thereby increasing the electric potential of the developer. Accordingly, the binding-force of the developer increases and thus the image transfer efficiency is improved.

For example, if the light is projected onto the organic photoconductive drum 110 having a surface electric potential of −800V through the first light path providing unit 162, the surface electric potential of the photosensitive drum 110 increases to −200V. Accordingly, the surface electric potential of the organic photoconductive drum 110 corresponding to the area not exposed to the light increases such that the binding-force of the developer decreases. Therefore, transfer efficiency is increased.

Reference numeral 170 indicates a protection guide plate to prevent the first light path providing unit 162 from being contaminated by falling developer during the developing process.

A light projecting end may be disposed on the first light path providing unit 162 at a position to prevent contamination thereof from the falling developer during a developing process. That is, the first light path providing unit 162 has the light projecting end disposed at a position corresponding to the pre-transfer lamp 60 disposed at position A as shown in FIG. 1.

The second light path providing unit 164 provides a light path to allow the other part of the incident light from the light sources 150*a* to be projected onto a predetermined area of the organic photoconductive drum 110 passing through the transfer roller 140, thereby removing the remainder of the latent image.

The light is projected onto the surface of the organic photoconductive drum 110 passing through the transfer roller 140 through the second light path providing unit 164, thereby removing a remaining latent image. Accordingly, the surface electric potential of the organic photoconductive drum 110 becomes uniform. Accordingly, an overlapped image that may be caused by the remaining latent image is prevented and thus the image of high resolution can be obtained.

In FIG. 3, the first and second light path providing units 162 and 164 use an optical fiber to advance the incident light from the light sources 150*a* by an inner total reflection. However, anything that is capable of advancing the incident light from the light sources 150*a* by the inner total reflection in a predetermined direction may alternately be used.

Figure 4:
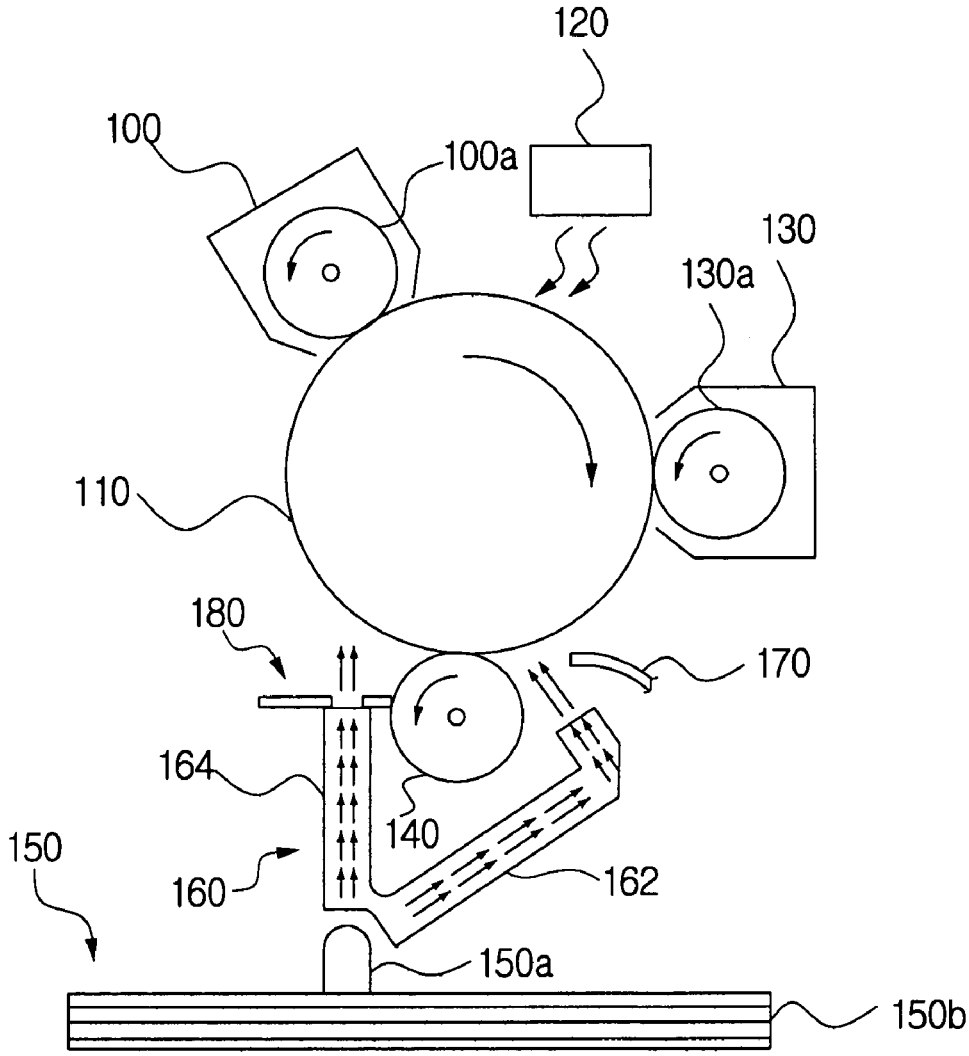
FIG. 4 is a schematic cross-sectional view showing an image forming device according to another embodiment of the present invention.

Meanwhile, as shown in FIG. 4, the first and second light path providing units 162 and 164 may have ends of surfaces thereof opposing the light sources 150*a* integrally formed with each other by being in linearly contact with each other. Also, the first and second light path providing units 162 and 164 may include light amount regulating slits 180 disposed at their light projecting ends, to regulate the amount of the light emitted from the light sources 150*a*.

The image forming device according to the embodiment of the present invention has a structure to divide and utilize the light emitted from the light sources 150*a*. Accordingly, it has a simplified structure.

Although an embodiment of the present invention has been shown and described, it will be appreciated by those skilled in the art that changes may be made in this embodiment without departing from the principles and spirit of the invention, the scope of which is defined in the claims and their equivalents.

What is claimed is:

1. An image forming device comprising:

an organic photoconductive medium;

a charging unit to electrically charge a surface of the organic photoconductive medium;

a light exposure unit to form an electrostatic latent image on the surface of the organic photoconductive medium;

a developing unit to develop the formed electrostatic latent image with a developer;

a transfer roller to transfer the developed image to a recording paper;

a light array comprising a plurality of light sources arranged in a predetermined pattern to emit light;

a first light path providing unit to provide a first light path to receive a first portion of the light emitted from the light sources and to allow the received first portion light to be projected on the photoconductive medium at a first position of the photoconductive medium between the developing unit and the transfer roller;

a second light path providing unit to form a second light path to receive a second portion of the light emitted from the light sources and to allow the received second portion light to be projected onto the photoconductive medium passing through the transfer roller at a second position of the photoconductive medium, thereby removing the electrostatic latent image from the surface of the organic photoconductive medium; and a plate, between the photoconductive medium and the first light path providing unit, to prevent the developer from passing from the photoconductive medium to the first light path providing unit, wherein the first and second positions are on a same side of the photoconductive medium as the light array.

2. The image forming device of claim 1, wherein the first and second light path providing units are optical fibers to advance the received first and second portion light by an inner total reflection.

3. The image forming device of claim 1, wherein the light sources are light emitting diodes.

4. An image forming device, comprising:

a photoconductive medium having an electrostatic image developed thereon with a developer;

a transfer unit to transfer the developed image to a recording medium;

a light source to emit light;

a light path unit to directly receive the emitted light and to transfer the emitted light to the photoconductive medium on opposite sides of the transfer unit;

a first light path unit to transfer the emitted light to the developed image prior to contacting the transfer unit;

a second light path unit to transfer the emitted light to the photoconductive medium after the image has been transferred; and a plate, between the photoconductive medium and the first light path unit, to prevent the developer from passing from the photoconductive medium to the first light path unit.

* * * * *